US006537096B2

(12) United States Patent
Szu et al.

(10) Patent No.: US 6,537,096 B2
(45) Date of Patent: Mar. 25, 2003

(54) ZIF SOCKET ASSEMBLY WITH IMPROVED PROTECTOR

(75) Inventors: Ming-Lun Szu, Tu-Chen (TW); Hsiang-Ping Chen, Tu-Chen (TW); Hao-Yun Ma, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/943,030

(22) Filed: Aug. 29, 2001

(65) Prior Publication Data

US 2003/0008545 A1 Jan. 9, 2003

(30) Foreign Application Priority Data

Jul. 4, 2001 (TW) ..... 90211199 U

(51) Int. Cl.[7] ..... H01R 4/50
(52) U.S. Cl. ..... 439/342
(58) Field of Search ..... 439/342, 259, 439/264, 266

(56) References Cited

U.S. PATENT DOCUMENTS 5,730,615 A * 3/1998 Lai et al. ..... 439/342

6,059,596 A * 5/2000 Pei et al. ..... 439/342

* cited by examiner

*Primary Examiner*—Lynn Field
*Assistant Examiner*—Phuong KT Dinh
(74) *Attorney, Agent, or Firm*—Wei Te Chung

(57) ABSTRACT

A ZIF socket assembly used with a package (6) comprises a ZIF socket (5), an actuating tool (8) and a protector (7). The socket comprises a base (51) and a sliding cover (53). The base comprises a recess (514) at an end thereof. The sliding cover is moveable assembled on the base for mounting the package and comprises a slot (533) in alignment with the recess. The protector is placed on the package and comprises a number of legs (71) extending downwardly for pressing against edges of the package. A contacting portion (73) extends outwardly from an edge of the protector and has a guiding face (75). The actuating tool is inserted into the recess through the slot and is rotatable from an initial, inclined position to a final, vertical position to drive the cover, the package and the protector to move with respect to the base.

7 Claims, 6 Drawing Sheets

ZIF SOCKET ASSEMBLY WITH IMPROVED PROTECTOR

BACKGROUND OF THE INVENTION

1. Field of the Invention

The present invention relates to a ZIF (Zero Insertion Force) socket assembly, and particularly to a ZIF socket assembly which has a sliding cover moveable on a base by an actuating tool without causing damage to an integrated circuit package.

2. Description of Related Art

ZIF socket is widely used for connecting an integrated circuit package with a printed circuit board. A conventional ZIF socket includes a base, a sliding cover moveably assembled on the base, and a cam lever rotatably sandwiched between the base and the sliding cover. The cam lever is manually rotated to drive the sliding cover to move on the base therebetween a ZIF connection position, i.e. an open position, and a closed position. Recently, for consideration of the miniaturization of all kinds of devices, particularly of the portable computer, the ZIF socket has to reduce its size or height. The conventional ZIF socket operated by a cam lever, which is for example disclosed in U.S. Pat. No. 5,057,031, cannot meet the trend of miniaturization. U.S. Pat. No. 5,730,615 discloses a low-profile ZIF socket of which a sliding cover is operated by an actuating tool and moves on a base. However, for ensuring enough movement of an integrated circuit package mounted on the sliding cover, the actuating tool will press against the integrated circuit package directly and may damage the integrated circuit package. Therefore, in actual application, a protector is provided upon the integrated circuit package for preventing the integrated circuit package from being subjected to force directly.

Referring to FIGS. 5 and 6, a ZIF socket assembly for connecting an integrated circuit package 2 with a mating printed circuit board (not shown) comprises a ZIF socket 1 and a protector 3. The ZIF socket 1 comprises a base 10 and a sliding cover 11 moveably assembled on the base 10. The base 10 comprises a recess 101 at an end thereof. The sliding cover 11 defines a slot 111 in vertical alignment with the recess 101 of the base 10. The integrated circuit package 2 is mounted on the sliding cover 11. The protector 3 is placed upon the integrated circuit package 2 and comprises a plurality of legs 31 extending downwardly from each edge thereof and pressing against the integrated circuit package 2. As is clearly shown in FIG. 6, in manipulation, an actuating tool 4 is inserted into the recess 101 through the slot 111 and rotated from an initial, vertical position (shown in phantom line) to an inclined position to drive the sliding cover 11 and the integrated circuit package 2 to move with respect to the base 10, thereby achieving an electrical connection between pins 20 of the package 2 and terminals 100 of the socket 1.

However, when the actuating tool 4 is rotated from the vertical position to the inclined position shown in FIG. 6, the actuating tool 4 will exert a large force F on the protector 3, of which a downward component P will press the package 2 through the protector 3 and may damage the package 2.

Hence, an improved protector arrangement is required to overcome the disadvantages of the conventional ZIF socket assembly. The instant invention is an improvement based upon the copending application Ser. No. 09/909,511 filed Aug. 3, 2001 with one common inventor and the same assignee.

SUMMARY OF THE INVENTION

Accordingly, the object of the present invention is to provide a ZIF socket assembly with an improved protector which can avoid exerting a downward force on a package when an actuating tool drives the package to move with respect to a base of the socket.

In order to achieve the object set forth, a ZIF socket assembly for use with an integrated circuit package comprises a socket, an actuating tool and a protector. The socket comprises a base, a plurality of terminals and a sliding cover. The base comprises a plurality of receiving passageways for receiving corresponding terminals and a lower flange extending outwardly from an edge thereof. The lower flange defines a recess in an upper face thereof. The sliding cover is moveably assembled on the base for receiving the package and comprises a plurality of through holes in vertical alignment with corresponding receiving passageways. An upper flange extends outwardly from an edge of the cover and defines a slot in vertical alignment with the recess of the base. The protector is placed on the package and comprises a plurality of legs extending downwardly for contacting with edges of the package. A contacting portion extends outwardly from an edge of the protector and forms a guiding face to guide an insertion of the actuating tool and to avoid exerting a downward force on the package. The actuating tool is enacted around the tool operation area, i.e., inserted into the recess through the slot, and is rotatable from an initial, inclined position to a final vertical position to press against the guiding face to drive the cover, the package and the protector to move with respect to the base, thereby achieving an electrical connection between the socket and the package.

Other objects, advantages and novel features of the invention will become more apparent from the following detailed description when taken in conjunction with the accompanying drawings.

DETAILED DESCRIPTION OF THE INVENTION

Figure 1:
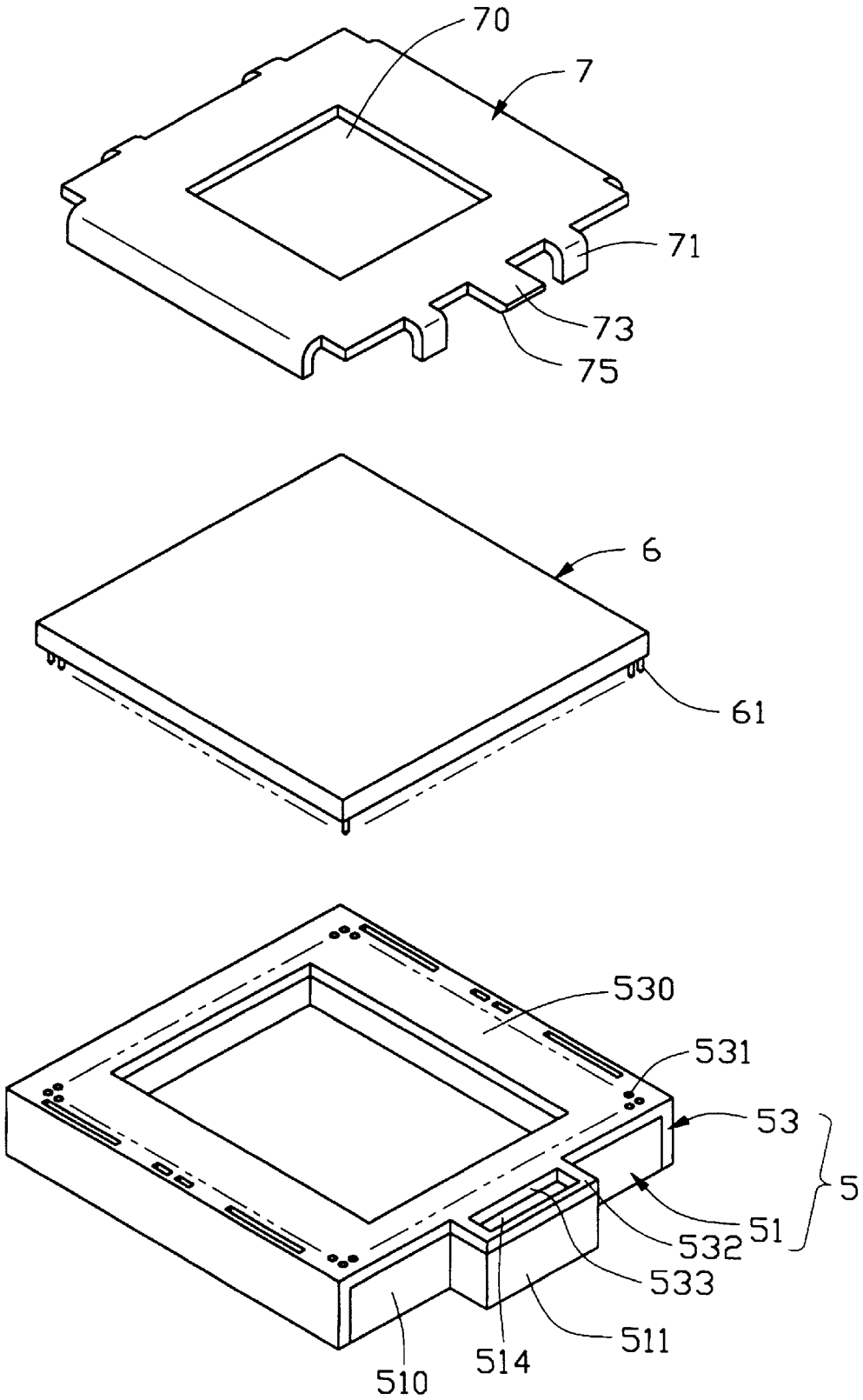
FIG. 1 is a perspective, exploded view of a ZIF socket assembly with a protector of the present invention.

Reference will now be made to the drawing figures to describe the present invention in detail.

Figure 3:
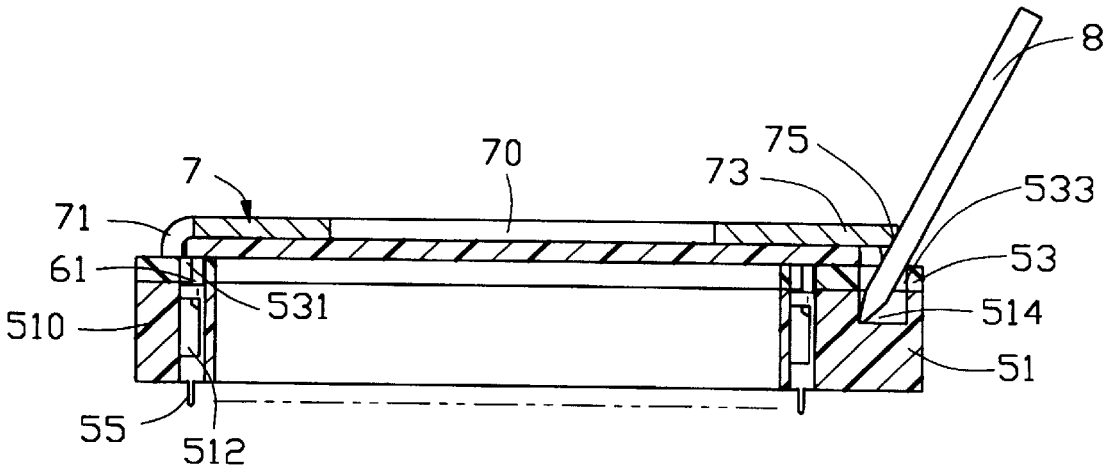
FIG. 3 is a cross-sectional view of the ZIF socket assembly showing an actuating tool in an initial, inclined position.

Referring to FIGS. 1 and 3, a ZIF socket assembly in accordance with the present invention comprises a ZIF socket 5, a protector 7, and an external actuating tool 8. The ZIF socket 5 comprises a base 51, a sliding cover 53 moveably assembled on the base 51, and a plurality of terminals 55 received in the base 51.

The base 51 comprises a lower rectangular member 510 and a lower flange 511 extending outwardly from an end of the lower rectangular member 510. The lower rectangular member 510 defines a plurality of spaced apart receiving passageways 512 extending vertically through the base 51 for receiving corresponding terminals 55. The lower flange 511 defines a recess 514 in an upper face thereof.

The sliding cover 53 comprises an upper rectangular member 530 and an upper flange 532 extending outwardly from an end of the upper rectangular member 530. The upper rectangular member 530 defines a plurality of through holes 531 in alignment with corresponding receiving passageways 512 of the base 51 for receiving corresponding pins 61 of a mating integrated circuit package 6 mounted on the sliding cover 53. The upper flange 532 defines a rectangular slot 533 in vertical alignment with the recess 514 of the base 51.

The protector 7 is assembled on the package 6, and comprises a square opening 70 in the middle thereof and a plurality of legs 71 extending downwardly from each edge thereof. A contacting portion 73 extends outwardly from an edge of the protector 7 and has a declining guiding face 75 extending inwardly from a free end thereof.

Figure 2:
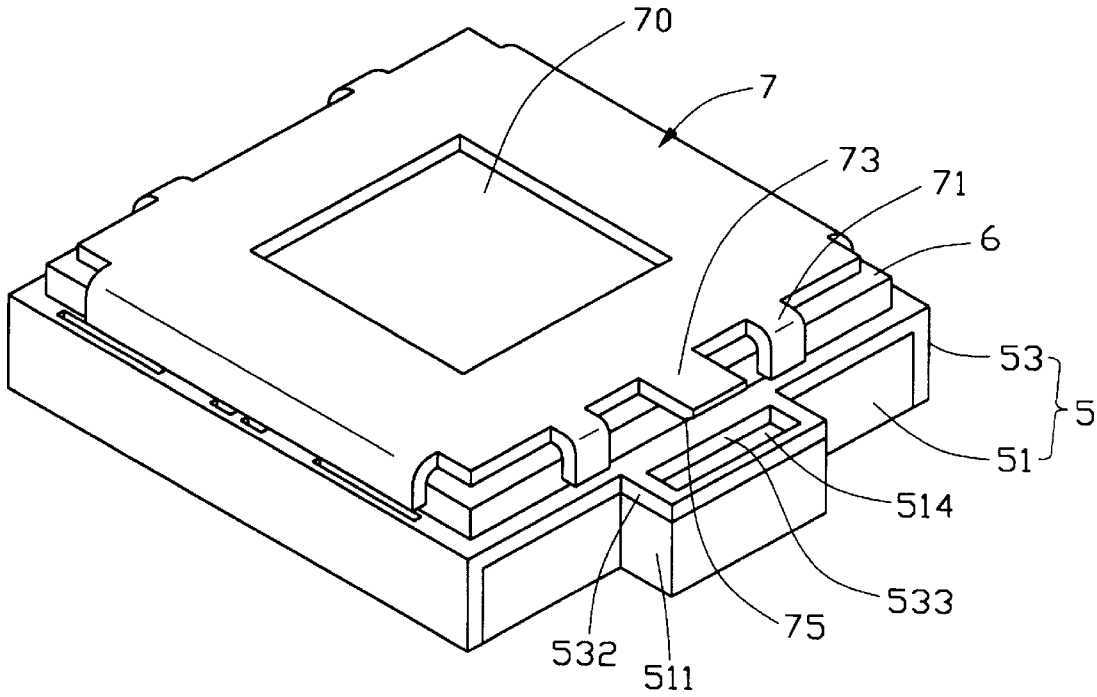
FIG. 2 is a perspective view of the assembled ZIF socket assembly.

In assembly, referring to FIGS. 2 and 3, the terminals 55 are placed in the receiving passageways 512 of the base 51 and the sliding cover 53 is moveably assembled on the base 51 with the through holes 531 in vertical alignment with corresponding receiving passageways 512. Subsequently, the package 6 is placed on the sliding cover 53 with the pins 61 received in corresponding receiving passageways 512 through corresponding through holes 531. The protector 7 is finally placed on the package 6 with the legs 71 pressing against edges of the package 6 and with the contacting portion 73 facing the flanges 511, 532.

Figure 4:
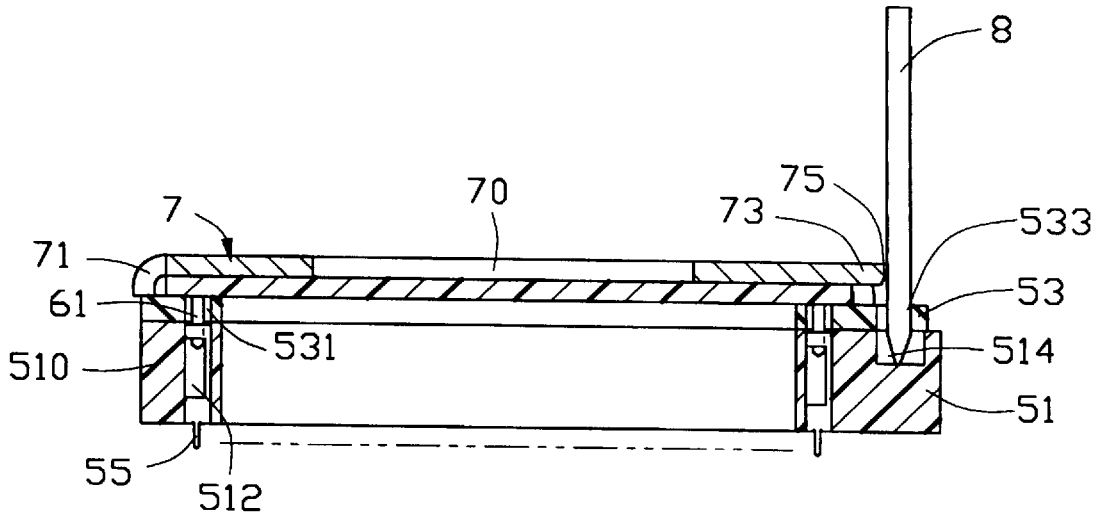
FIG. 4 is a cross-sectional view of the ZIF socket assembly showing an actuating tool in a final, vertical position.
Figure 5:
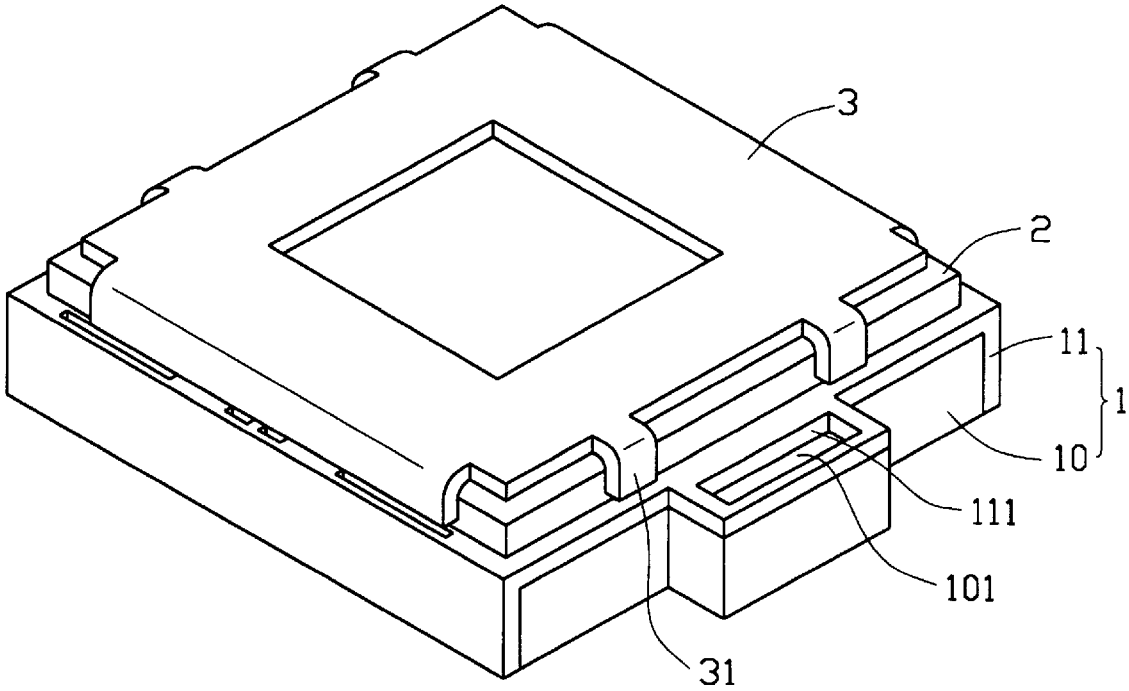
FIG. 5 (PRIOR ART)
FIG. 5 is a perspective assembled view of a related ZIF socket assembly with a protector.
Figure 6:
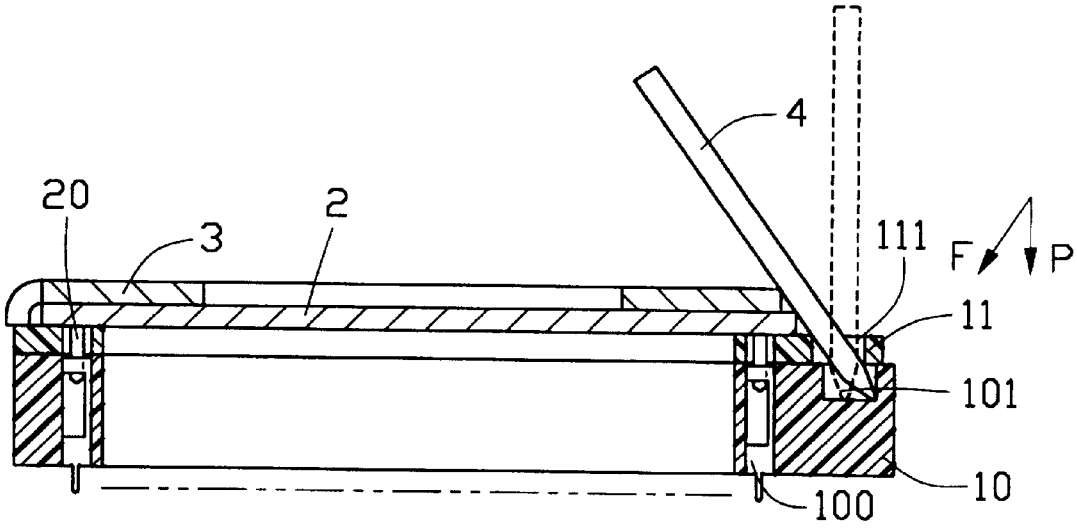
FIG. 6 (PRIOR ART)
FIG. 6 is a cross-sectional view similar to FIG. 3, but showing operation of the related socket of FIG. 5.

Referring to FIGS. 3 and 4, in manipulation, the actuating tool 8 is inserted into the recess 514 of the base 51 through the slot 533 of the sliding cover 53 along the guiding face 75 of the contacting position 73. Successively, the actuating tool 8 is rotated from an initial, inclined position (FIG. 3) to a final, substantially vertical position (FIG. 4). A horizontal component of an actuating force exerted on the protector 7 and the integrated circuit package 6 drives the sliding cover 53, the protector 7 and the integrated circuit package 6 to move with respect to the base 51. Therefore, an electrical connection between the pins 61 of the package 6 and the terminals 55 of the socket 5 is achieved.

Since the outwardly extending contacting portion 73 has a guiding face 75 extending inwardly from the free end of the protector 7, the actuating tool 8 guided by the guiding face 75 of the protector 7 and pressing against the free end of the protector 7 will exert a substantially horizontal force or slightly upwardly force against the protector 7. Thus, the integrated circuit package 6 is protected from being subject to a downward force which will otherwise may cause damage to the package 6.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A ZIF (Zero Insertion Force) socket assembly for use with an integrated circuit package, comprising:

a ZIF socket comprising a base with a plurality of receiving passageways, and a plurality of terminals received in the receiving passageways of the base;

a protector placed above the ZIF socket, the protector comprising a plurality of legs extending downwardly for pressing against edges of the package and a contacting portion extending outwardly from an edge thereof, the contacting portion defining a guiding face; and an external actuating tool engageable with the base, the actuating tool being rotatable from an initial, inclined position where the actuating tool is guided by and presses against the guiding face of the contacting portion of the protector to a final substantially vertical position where the actuating tool presses against the contacting portion of the protector.

2. The ZIF socket assembly as described in claim 1, further comprising a sliding cover moveably assembled on the base for carrying the integrated circuit package.

3. The ZIF socket assembly as described in claim 2, wherein the base defines a recess at an end thereof, the sliding cover defines a slot in vertical alignment with the recess, and the external actuating tool is inserted into the recess through the slot.

4. The ZIF socket assembly as described in claim 2, wherein the sliding cover defines a plurality of through holes in alignment with the receiving passageways for receiving corresponding pins of the integrated circuit package.

5. The ZIF socket assembly as described in claim 2, wherein the guiding face extends inwardly from a free end of the contacting portion of the protector.

6. A ZIF socket assembly comprising:

a socket comprising a base with a plurality of terminals therein, and a sliding cover mounted upon the base with a plurality of through holes in vertical alignment with the corresponding terminals, respectively;

a tool operation area located on a rear portion of the socket;

an integrated circuit package seated upon the cover, said package including a plurality of pins downwardly extending through the corresponding through holes and engaged with the corresponding terminals, respectively; and a protector placed upon said socket and said package, said protector including a plurality of downwardly extending legs grasping the package, and a contacting portion formed on a rear edge of the protector in alignment with said tool operation area in a front-to-back direction; wherein said contacting portion extends rearwardly substantially beyond, in said front-to-back direction, the corresponding legs located on the rear edge of the protector, and said contacting portion is dimensioned with a length, along said front-to-back direction, not only small enough for not hindering obliquely approaching of a tool around the tool operation area but also large enough for maintaining the tool in a vertical stop position not to improperly engage the package.

7. A method of actuating an integrated circuit package on a ZIF socket, comprising the steps of:

providing a socket with a base and a sliding cover thereon, said socket being equipped with a plurality of terminals therein, said cover being equipped with a plurality of through holes in vertical alignment with the corresponding terminals, respectively, said cover being slidable relative to the base along a front-to-back direction;

formed a tool operation area around a rear portion of the socket;

positioning an integrated circuit package upon the socket with pins extending downwardly through the corresponding through holes and engaged with the corresponding terminals, respectively;

mounting a protector upon the package with downwardly extending legs grasping the package and a contacting portion rearwardly extending from a rear edge thereof toward said tool operation area, with a minimum distance beyond corresponding legs on the rear edge in said front-to-back direction;

initially obliquely positioning the tool around the tool operation area and engaging the contacting portion to actuate the cover to move forward until the tool is in a vertical final position, wherein a rear edge of the integrated circuit package is consistently spaced from the tool during this operation.

* * * * *